US006470530B1

(12) United States Patent
Trunkle

(10) Patent No.: US 6,470,530 B1
(45) Date of Patent: Oct. 29, 2002

(54) EXTERNALLY MOUNTED WINDOW SPRING BALANCE REPLACEMENT DEVICE ASSEMBLY

(76) Inventor: Timothy Trunkle, 324 Hollywood Dr., Charleston, SC (US) 29407

( * ) Notice: Subject to any disclaimer, the term of this patent is extended or adjusted under 35 U.S.C. 154(b) by 71 days.

(21) Appl. No.: 09/666,247

(22) Filed: Sep. 21, 2000

Related U.S. Application Data

(60) Provisional application No. 60/154,792, filed on Sep. 20, 1999.

(51) Int. Cl.[7] ..... E05F 3/18
(52) U.S. Cl. ..... 16/197; 49/429
(58) Field of Search ..... 16/197, 193, 194, 16/196, 198, 199, 200, 201, 195, 401; 267/178; 49/249

(56) References Cited

U.S. PATENT DOCUMENTS

| | | | | | |
|---|---|---|---|---|---|
| 494,959 | A | | 4/1893 | Kimball | |
| 518,278 | A | | 4/1894 | Rosentreter | |
| 601,283 | A | | 3/1898 | Sawyer et al. | |
| 869,512 | A | | 10/1907 | Ocumpaugh | |
| 1,121,228 | A | | 12/1914 | Burkhart | |
| 2,637,875 | A | | 5/1953 | Hess | |
| 2,659,929 | A | | 11/1953 | Hess | |
| 2,817,872 | A | | 12/1957 | Foster | |
| 3,521,320 | A | * | 7/1970 | Perry | 16/197 |
| 4,190,930 | A | * | 3/1980 | Prosser | 16/197 |
| 4,685,175 | A | * | 8/1987 | Yonovich | 16/197 |
| 4,949,425 | A | * | 8/1990 | Dodson et al. | 16/197 |
| 5,924,683 | A | | 7/1999 | Alchin | |
| 6,148,562 | A | * | 11/2000 | Stark et al. | 49/429 |

* cited by examiner

*Primary Examiner*—Lynne H. Browne
*Assistant Examiner*—Doug Hutton
(74) *Attorney, Agent, or Firm*—D. Peter Hochberg; Katherine R. Vieyra; William H. Holt

(57) ABSTRACT

The invention is an externally mounted window spring balance device assembly for installation on single or double-hung sash windows either not originally equipped with a counter balance device or on single or double-hung sash windows where the counter balance device has become inoperative due to broken or worn out parts. The externally mounted window spring balance replacement device assembly eliminates the need to disassemble the window frame to access broken or worn out parts located internal to the window frame.

7 Claims, 5 Drawing Sheets

EXTERNALLY MOUNTED WINDOW SPRING BALANCE REPLACEMENT DEVICE ASSEMBLY

CROSS-REFERENCE TO RELATED APPLICATION

This application claims the benefit of U.S. Provisional Application No. 60/154,792 filed Sep. 20, 1999.

BACKGROUND OF THE INVENTION

1. Field of the Invention

The present invention relates generally to spring balance systems for sliding windows. More particularly, the invention relates to an externally mounted replacement window spring balance device assembly for single or double-hung sash windows.

2. Description of the Prior Art

A typical window frame assembly includes two or more glass panes secured, respectively, in an upper window frame and a lower window frame. The lower window frame is generally moveable from a closed position upwardly to an open position adjacent to and alongside the upper window frame.

The present invention addresses a common problem of maintaining the lower window sash in the open position. This condition is encountered when one or both of the window spring balances or other counter balance devices, typically mounted internally to the window frame and laterally opposed to the lower sash edges, become inoperative. Additionally, some windows utilize friction between the lower sash edges and the window frame guide to keep the lower window sash in the open position. Over time the frictional forces may lessen due to frictional wear. The lower window sash may even suddenly fall to the closed position, making a loud noise and causing the glass to crack or shatter. There exists the possibility that injury could occur due to the falling window or the broken glass. Even with window sashes equipped with a mechanism to keep the window in the open position, if the mechanism becomes inoperative and the frictional forces of the window sash edges and the frame guide lessen over time, the potential for the window unexpectedly falling still exists.

There are several U.S. patents that disclose devices for overcoming this problem. For example, U.S. Pat. No. 494,959 issued to Kimball describes a sash balance where a case with a spring drum is attached to the window jamb, and a tape connected to the drum is extended down and attached to the sash.

U.S. Pat. No. 518,278 issued to Rosentreter discloses a sash balance that is designed to be thin so it may be adapted to car windows as well as windows of larger size. The sash balance consists of a case with a side plate, a drum fitted thereto, a rivet uniting the parts, a spring connecting the drum with a hub of the case, a tape winding on the drum, a spring disk set into a cavity of the case held by the rivet and serving to draw against the side plate.

U.S. Pat. No. 601,283 issued to Sawyer, et al. claims a sash lift comprising parallel, vertical brackets, a spring-actuated revoluble shaft mounted transversely therein, a grooved drum mounted on said shaft and revolving therewith, a sash cord adapted to wind in said drum and connected with the sash, a peripheral ratchet on said drum, a pawl adapted to engage therewith, a pivoted bell-crank lever mounted on one of the side rails of the window-casing, a cord connecting the pawl and an arm of the bell-crank lever, a pull rod provided with a knob-ended integral right-angular arm at its lower end, said rod adapted to move vertically in a stationary cylindrical casing secured to the side rail of the window casing below said pivoted bell crank lever, and a cord connecting said rod with one arm of said bell crank lever.

U.S. Pat. No. 869,512 issued to Ocumpaugh discloses a drum casing for sash balances and pulleys for placement of the type for placement on the upper window casing. The casing is for containing a coil type spring and a recoiling tape for attachment to the lower window sash.

U.S. Pat. No. 1,121,228 issued to Burkhart describes an automatic sash lock and opener. The device will automatically lock the sash when it is moved to its closed position. The device also automatically opens the sash to a predetermined height when the locking mechanism is released. The device consists of a keeper having a downwardly facing shoulder secured to one side of the frame, a vertically disposed rod connected to the lower end of the sash, the upper end of the rod being bent to form a hook for engagement under the shoulder of the keeper when the sash is moved to the closed position, means for releasing the hooked upper end of the rod from beneath the shoulder of the keeper, and means for automatically drawing the rod upwardly after the same has been released from the keeper to open the sash a predetermined distance.

U.S. Pat. Nos. 2,637,875 and 2,659,929 issued to Hess discloses a spring assembly that can be used as a window balance. The spring balance is comprised of pre-tensioned and pre-torsioned helical spring secured at one end to a rod which is axially arranged within the spring and mounted for rotation in a bracket. The rod is provided with an abutment on its end to maintain it in assembled position. The bracket is for attachment to a movable object such as a window frame. The opposite end of the spring is attached to a guide which is a tube having a guideway at its upper end for the reception of the rod, which rod and guide are adapted to move relatively in respect of each other in axial and rotative directions. A securing member attaches the guide tube as well as the spring to a bracket which is adapted to be secured to the window sash.

U.S. Pat. No. 2,817,872 issued to Foster discloses a window sash balance comprising a housing with an enlarged portion provided with a partial circumferential surface, a tongue portion integral with the housing and flanged around its periphery and extending from the opposite end of the enlarged portion, a tongue portion integral with the housing and flanged around its periphery and extending from the opposite end of the enlarged portion, a plurality of cross ribs extending across the tongue portion and connected to the flanges around the periphery, and the housing being adapted to receive a coiled ribbon spring which rotates on the part-circumferential surface when the window is raised or lowered.

Finally, U.S. Pat. No. 5,924,683 issued to Alchin describes a spring balance system for sliding windows. The system is a self contained apparatus comprised of a small diameter tube and a larger diameter tube. The two tubes are telescopic with respect to one another. A spring extends through the length of both tubes. At one end there is a means for attaching the apparatus to a sliding window. The other end comprises a support.

SUMMARY OF THE INVENTION

It is an object of the present invention to provide an externally mounted replacement window spring balance device assembly which eliminates the need to disassemble the framework of the broken window assembly to access the internal broken or worn out balance device for replacement.

It is another object of the invention to provide an externally mounted replacement window spring balance device assembly which can support windows having internal window spring balances, counter weight devices, and windows previously utilizing track friction which has lessened due to wear.

It is another object of the invention to provide an externally mounted replacement window spring balance device assembly wherein the assembly mounts externally to the window frame assembly.

It is another object of the invention to provide an externally mounted replacement window spring balance device assembly which is versatile to use on almost any size or weight window sash through the availability of various lengths and strengths commercially available window spring balances, It is another object of the invention to provide an externally mounted replacement window spring balance device assembly which does not require disassembly of the window frame and accompanying trim work.

It is another object of the invention to provide an externally mounted replacement window spring balance device assembly which eliminates the need to caulk and repaint the window frame and trim work after repair.

It is another object of the invention to provide an externally mounted replacement window spring balance device assembly which uses standard mechanical fasteners, such as screws, and a screwdriver for installation.

It is another object of the invention to provide an externally mounted replacement window spring balance device assembly which reduces the time required to repair a window assembly with broken or worn out balance devices.

It is another object of the invention to provide an externally mounted replacement window spring balance device assembly which allows simple and easy installation by persons with limited mechanical, handyman, or craftsmanship skills.

It is another object of the invention to provide an externally mounted replacement window spring balance device assembly which does not interfere with window dressings such as window blinds which mount on top of the window frame.

It is another object of the invention to provide an externally mounted replacement window spring balance device assembly which allows the window spring tension to be increased or decreased without disassembling the window frame.

It is another object of the invention to provide an externally mounted replacement window spring balance device assembly which resembles standard wood window trim.

It is another object of the invention to provide an externally mounted replacement window spring balance device assembly which is easily removable for standard maintenance of the window frame and/or sashes, such as for painting.

It is another object of the invention to provide an externally mounted replacement window spring balance device assembly which allows the outer cover to be interchangeable with differently decorated or shaped covers.

The foregoing and other objects of the invention are achieved by an externally mounted replacement window spring balance device assembly comprised of a housing, a spring balance, a housing cover, a top cap, a bottom cap, and a track which engages longitudinal grooves formed in the housing.

DESCRIPTION OF THE PREFERRED EMBODIMENTS

Figure 1:
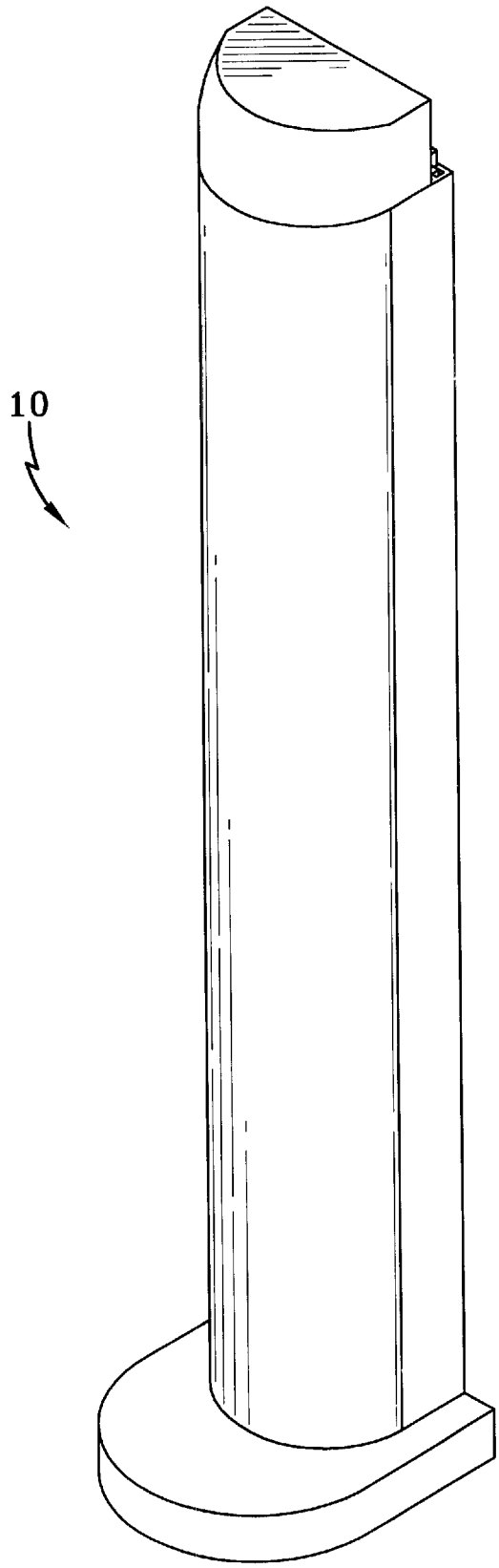
FIG. 1 is a perspective view of the preferred embodiment of the invention.
Figure 6:
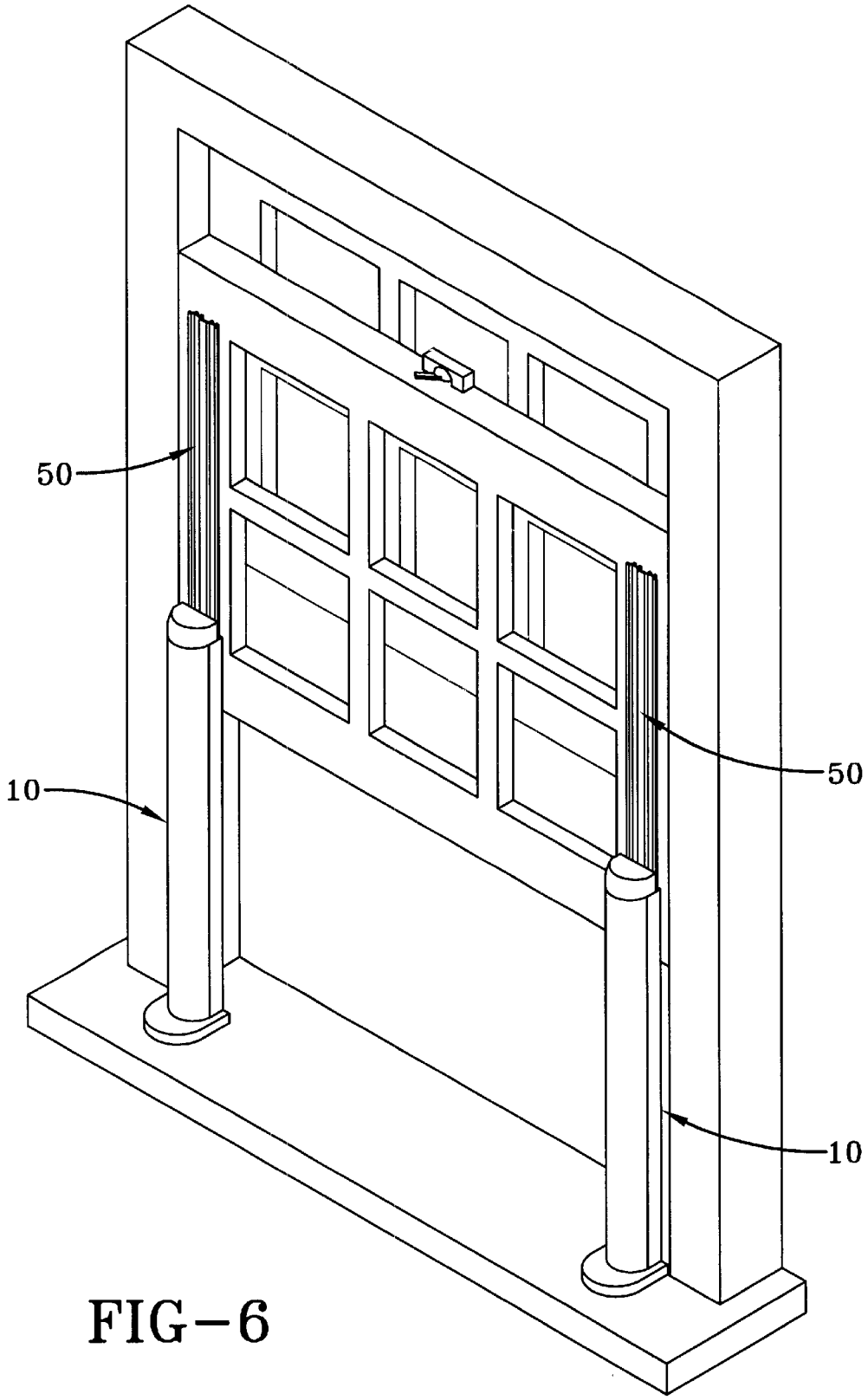
FIG. 6 is a perspective view of the invention shown in FIG. 1 installed on the lower window sash of a double-hung window sash and holding the lower window sash in the open position.

Referring now to FIG. 1, a preferred aspect of the externally mounted spring balance replacement device assembly 10 is shown. Device 10 is mounted externally on each of the opposing lateral window frames of the lower window sash (FIG. 6). The device 10 is intended as an aftermarket solution for windows that have no means for assisting in the opening/closing of the window or for holding the window in the open position. It is also intended as an aftermarket replacement for windows that were originally equipped with such a means, but for whatever reason, the means has become inoperative. Device 10 provides a mechanical advantage in the opening of a window. Many older style windows are made from wood and can be quite heavy. Opening these windows may require a great deal of strength not only to lift the window, but also to overcome the frictional forces between the lateral edges of the window sash and the window track. Once open, the frictional forces between the lateral edges of the window and the window track may hold the window open but if they do not, the window will simply fall back into the closed position under its own weight. In many windows, the frictional forces between the lateral edges of the window sash and window track diminish over time due to wear. Such windows will not stay in the open position without being propped up. Closing the window presents equal difficulties because the heavy window requires great strength to lower the window slowly to prevent it from slamming shut. There are windows equipped with a means for assisting in the opening/closing of the window and holding it in the open position. Examples of some of these type of means can be found in the prior art discussed above. Many of these means were designed as an integral part of the window/window frame assembly. Such means include spring balance systems and pulley/cord and counterweight systems located internally in the window frame. Eventually, these systems may become inoperative due to neglect, wear, breakage of the cords, etc. Repairing these systems require disassembly of the frame assembly housing the systems, which is not only laborious, but time consuming and expensive as well. For windows either equipped with such a means or not, the device 10 provides a low cost, simple, easy to install solution to the window opening/closing and holding open problem.

Figure 2:
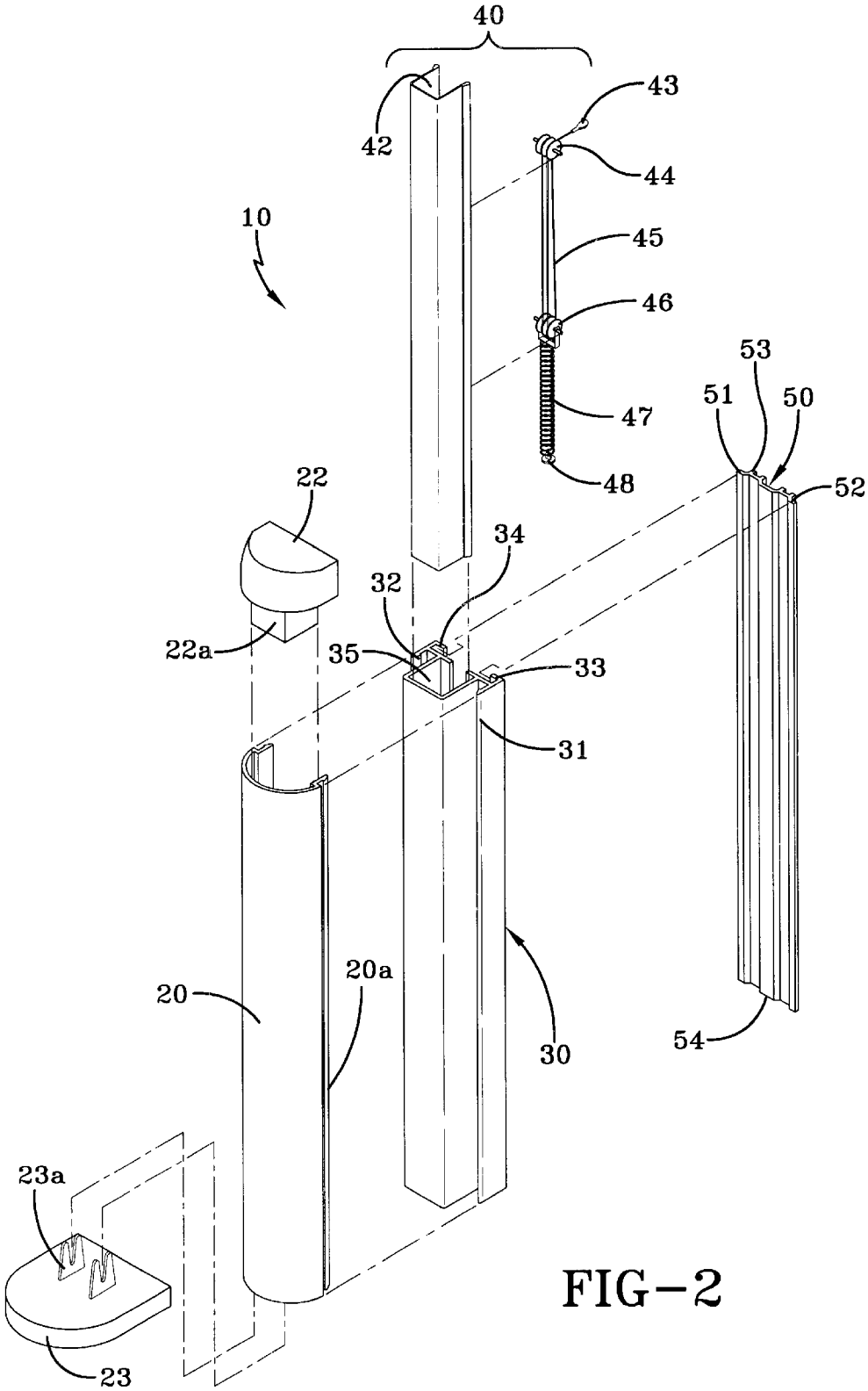
FIG. 2 is an exploded perspective view of the invention shown in FIG. 1.

Referring now to FIG. 2, an exploded view of the preferred aspect of the device 10 is shown. A central assembly housing 30 provides the central framework of device 10 and includes a longitudinally extending central channel 35 wherein a spring balance assembly 40 is inserted. Spring balance assembly 40 is comprised of a longitudinally extending U-shaped structural member 41 having a central cavity 42. Member 41 is generally made of metal but the material is mostly a matter of design choice by the manufacturer of spring balance 40. Spring balance assembly 40 is a well known, commercially available, and off the shelf device that has been adapted for use herein. Spring balance assembly 40 also includes a pair of double pulleys 44 and 46 arranged in opposing positions and a cord 45 looped therebetween. Pulleys 44 and 46 are biased in opposing positions by a spring 47. Spring 47 is located directly beneath the lower of the two pulleys, or pulley 46, and connected directly thereto at one end so that the biasing forces of spring 47 is transmitted to the pulley and cord arrangement. The opposite end of spring 47 is connected to a lug 48 for attachment to the lowermost end of member 41 inside cavity 42. The free end of cord 45 extends out of the upper pulley, or pulley 44, and has a hook attached it for the purposes described below. The remainder of cord 45 loops through the sheaves of pulley 44 and 46 so that a block and tackle type arrangement is formed. The opposite end of cord 45 is permanently fixed to the body of pulley 46. When the end of cord 45 with hook 43 on it is pulled with a force greater than the biasing force of spring 47, pulleys 44 and 46 are caused to be pulled toward each other through the tensile forces in cord 45. When enough force has been removed from the end of cord 45, the biasing force of spring 47 will cause pulleys 45 and 47 to be pulled away from each other through the now opposite tensile forces in cord 45. The entire assembly consisting of lug 48, spring 47, pulleys 44 and 46, cord 45, and hook 43 are permanently mounted within cavity 42 of member 41. The entire spring balance assembly 41 is inserted into cavity 35 and locked into place as described hereinbelow.

Figure 4:
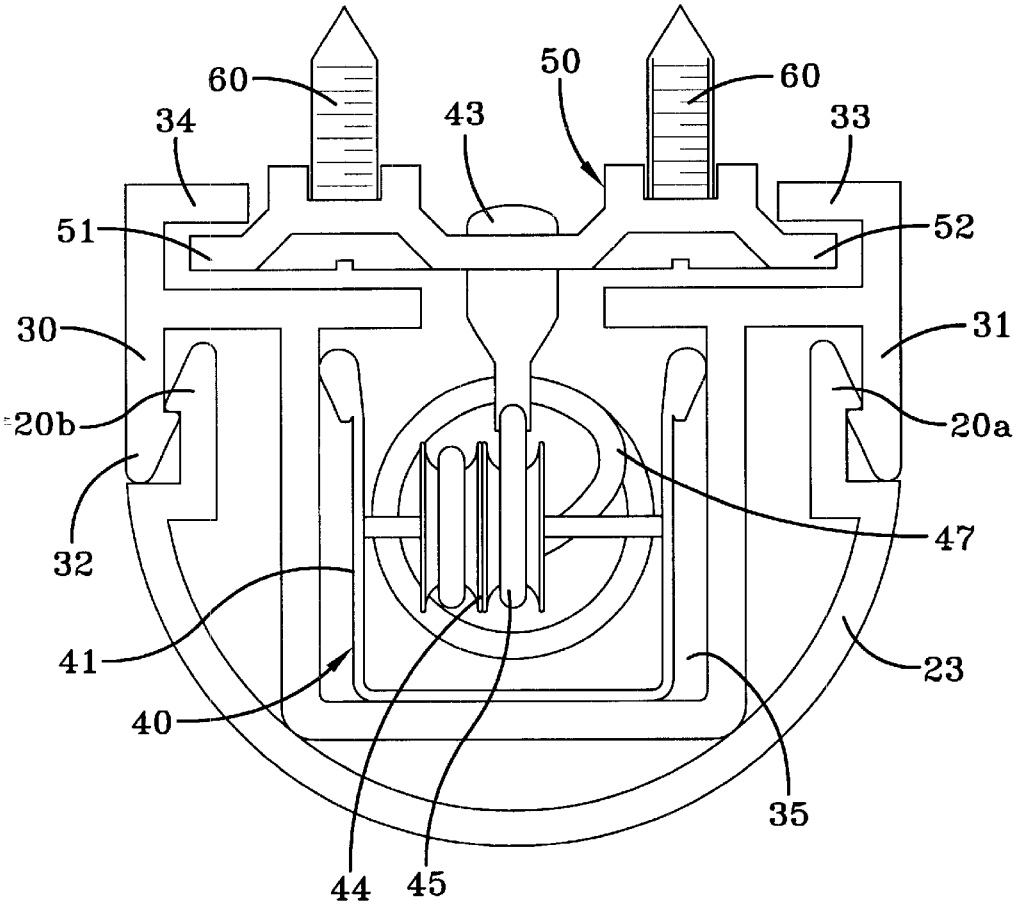
FIG. 4 is top view of the spring balance assembly inserted into the housing assembly of the invention shown in FIG. 1 showing the detail of the gripper hook.

For ornamental purposes, a housing cover 20 attaches to the front side of housing assembly 30. In the preferred aspect of the invention, housing cover 20 is a semi-circular shaped channel section having a tongue and groove formation on rearward facing opposing longitudinal edges 20*a* and 20*b*. Edges 20*a* and 20*b* are received by a complementary tongue and groove formation on forward facing longitudinal edges 31 and 32 of housing assembly 30. The ridges of the tongue formation of edge 20*b* (FIG. 4) engage the ridges of the tongue formation of edge 32 and lock housing cover 20 to housing assembly 30. The ridges of the tongue formation of edge 20*a* engage the ridges of the tongue formation of edge 31 and lock housing cover 20 to housing assembly 30 (FIG. 4). A, cap 22 is installed on the top of housing assembly 30 and cover 20 by inserting a tongue portion 22*a* of cap 22 into the top end of channel 35 in a semi-interference type fit. A base portion 23 is installed on the bottom end of housing assembly 30 and cover 20 utilizing a pair of clips 23*a* which protrude from an upper surface of base portion 23 and clip to a bar (not shown) located at the bottom of member 41 in cavity 42. 20 Base portion 23 could also be secured to the bottom end of housing assembly 30 and cover 20 utilizing a plurality of protruding knobs which engage holes in the bottom of member 41. A window track 50 is also provided for installation on the window frame being secured thereto on the rearward side by a track attachment means. The frontward side of window track 50 is slidably attached to the rear side of assembly housing 30. A pair receiver tracks 33 and 34 are located on the opposing longitudinal edges of the rear side of housing 30. Receiver tracks 33 and 34 receive a complementary pair of window track wings 51 and 52 located on the opposing longitudinal edges of window track 50. In this manner, window track 50 is free to slide relative to housing assembly 30. A plurality of longitudinal ribs 53 are located on the rearward side of track 50 for providing rigidity and stiffness to window track 50. When window track 50 is installed, ribs 53 abut the window frame window track 50 is installed on. Window track 50 is inserted into the top of assembly housing 30 by aligning the window track wings 51 and 52 with the respective receiver tracks 33 and 34 and sliding track 50 downward. After track 50 is partially inserted into assembly housing 30 the bottom edge 54 of track 50 will engage hook 43 so that any further insertion of track 50 will cause hook 43 to tension cord 45. As window track 50 continues to travel downward along the length of housing assembly 30, more of cord 45 is pulled from the double pulley arrangement and pulleys 44 and 46 are drawn closer to each other. There remains a constant biasing force transmitted from spring 47 to the arrangement to return pulleys 44 and 46 to their original positions prior to cord 45 being tensioned.

Figure 3:
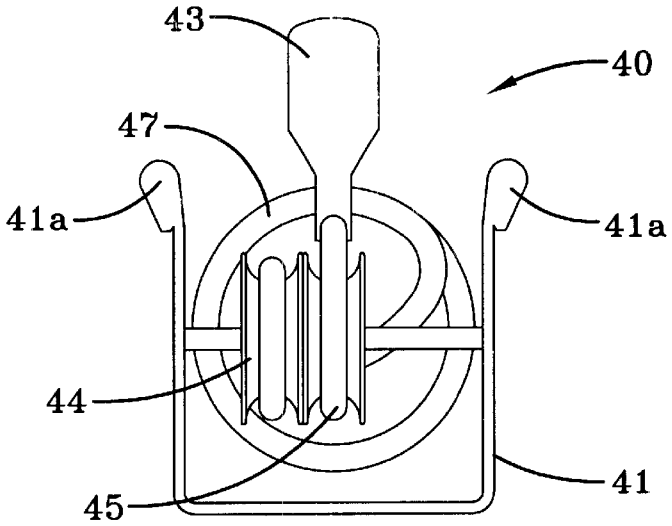
FIG. 3 is a top view of the spring balance assembly of the invention shown in FIG. 1.

Referring now to FIG. 3, shown is an end view of spring balance assembly 40. Hook 43 is attached to cord 45 which loops around one of the sheaves of double pulley 44 before looping around to the corresponding sheave on double pulley 46 (not shown). A pair of wings 41*a* protrude outwardly from the longitudinal edges of member 41.

Referring to FIG. 4, when spring balance assembly 40 is inserted into channel 35, the wings 41*a* on the opposing longitudinal edges of member 41 expand outwardly and grip the inner sidewalls of channel 35, thereby holding spring balance assembly 40 in place in channel 35. Track 50 is attached to the window frame member with screws 60.

Figure 5:
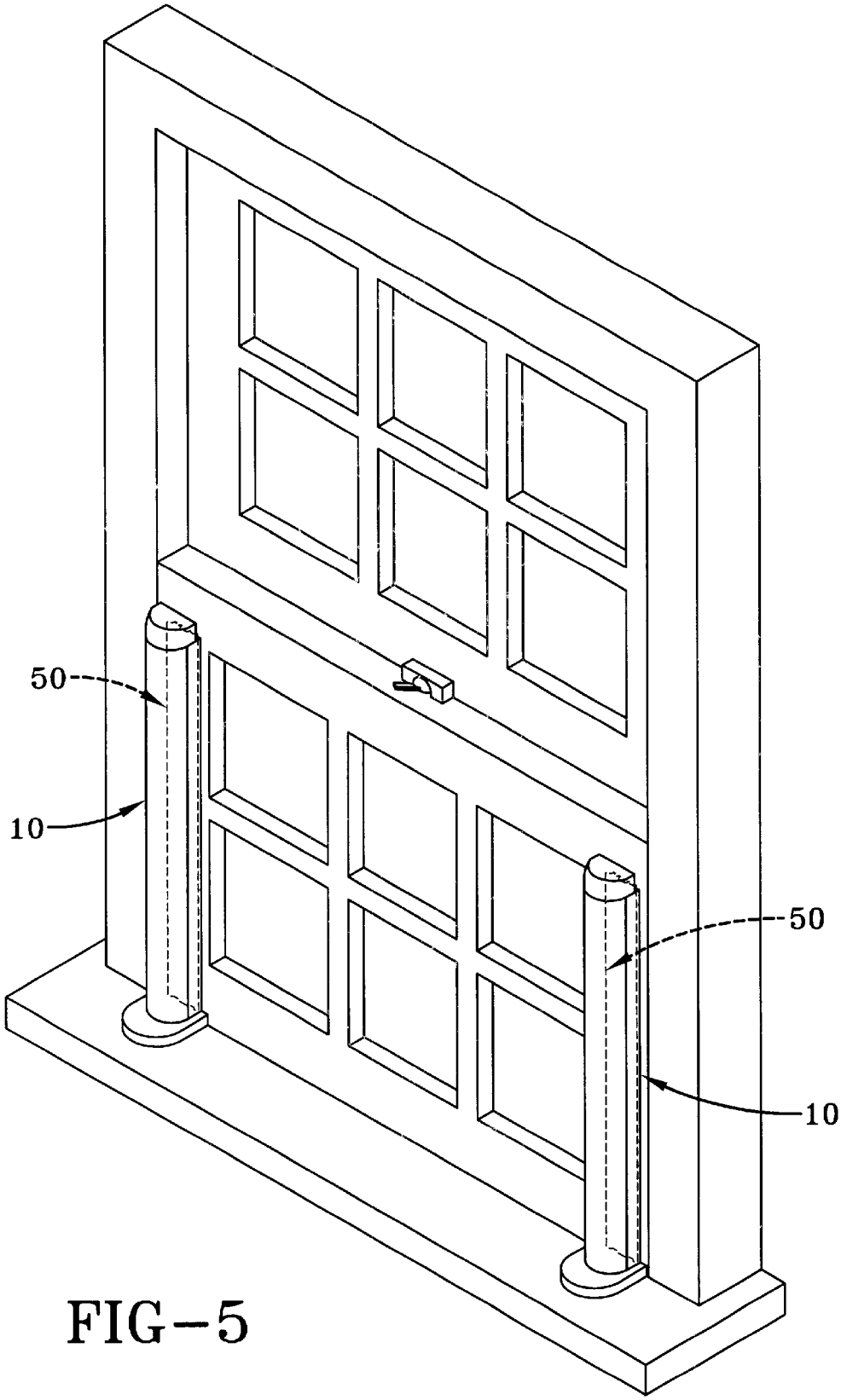
FIG. 5 is a perspective view of the invention shown in FIG. 1 installed on the lower window sash of a double-hung window sash with the lower window sash in the closed position.

Referring to FIG. 5, a device 10 is installed on the opposing lateral frame members of the lower window sash. The lower end of device 10 abuts the window sill and is attached to the sill at base portion 23 by a screw. When the lower window sash is in the closed position, device 10 imparts a constant upward vertical force against the window frame member it is attached to by virtue of the double pulley arrangement transmitting the potential energy stored in spring 47 through cord 45 and hook 43 to the track 51 attached to the window frame member. The vertical forces imparted to the window frame members are sufficient to overcome the gravitational forces of the window mass as well as the frictional forces between the opposing lateral edges of the window frame members and the window track. However, the additional restraining force created by the window lock prevents the window from moving upward. The potential energy stored in the spring 47 was created when the window was shut causing the pair of opposing double pulleys to contract towards each other and spring 47 to expand. This potential energy is released when the window lock is released and its restraining force is removed.

Referring now to FIG. 6, the vertical force imparted to the opposing window frame members now causes the window to move to the open position. The limit of travel of the window is defined by the travel distance of track 50 relative to housing assembly 30 which is defined by the length of track 50, the length of spring 47, and the travel distance between pulleys 44 and 46 as they contract towards one another. These parameters are chosen during the design phase of the device 10 and are chosen based upon the particular intended window installation.

The invention has been described in detail, with particular emphasis being placed on the preferred embodiments thereof, but variations and modifications within the spirit and scope of the invention may occur to those skilled in the art to which the invention pertains.

I claim:

1. An externally mounted window spring balance replacement device assembly for mounting on a lateral window frame member of a single or double-hung window sash for providing a mechanical advantage in the opening and closing of the window sash and holding the window sash in an open position, comprising:

a housing having a longitudinally extending central channel;

a housing cover that attaches to a front side of said housing;

a cap installed on a top of said housing which includes a tongue portion which is inserted into a top end of said central channel and secured thereto in a semi-interference fit;

a base portion installed on a bottom end of said housing and said housing cover;

a window track which is slidably attached to a rear side of said housing on a frontward side and to the window frame member by a track attachment means on a rearward side and further includes a plurality of longitudinal ribs located on a rearward side of said window track for providing rigidity and stiffness to said window track; and a device for generating a mechanical advantage located within said housing which is transmitted to the window frame member by said housing and said window track for aiding in the opening and closing of the window and holding the window in the open position.

2. The externally mounted window spring balance replacement device assembly of claim 1 wherein said device includes a spring balance assembly which further includes a member having a cavity, a spring for storing potential energy, a pair of double pulleys arranged in opposed positions wherein one of said pulleys is attached to one end of said spring, a cord looped between said pair of opposed pulleys, a lug connected to an opposite end of said spring for attachment to a lowermost end of said member, a hook attached to a free end of said cord for further attachment to a bottom edge of said window track, and wherein said pair of pulleys are biased in the opposed positions by said spring and said pair of pulleys are pulled toward each other in response to a tensile force applied to said cord by said hook, and said pair of pulleys return to the opposed positions when the tensile force is released.

3. The externally mounted window spring balance replacement device assembly of claim 2 wherein:

said housing cover further includes rearward facing opposing longitudinal edges and a tongue and groove formation on said rearward facing opposing longitudinal edges; and said housing further includes forward facing opposing longitudinal edges and a tongue and groove formation located on said forward facing opposing longitudinal edges complementary to said rearward facing opposing longitudinal edges of said housing cover, for receiving said rearward facing opposing longitudinal edges of said housing cover to attach and lock said housing cover to said housing.

4. The externally mounted window spring balance replacement device assembly of claim 1 wherein a rear side of said housing further includes opposing longitudinal edges and a pair of receiver tracks located on said opposing longitudinal edges, said window track includes a complementary pair of window track wings located on the opposing longitudinal edges for slidaby attaching said housing to said window track.

5. The externally mounted window spring balance replacement device assembly of claim 2 wherein said base portion further includes a pair of clips protruding from an upper surface of said base portion which clip to a bar located at a bottom end of said member.

6. The externally mounted window spring balance replacement device assembly of claim 2 wherein said base portion further includes a plurality of protruding knobs which engage holes in a bottom end of said member.

7. The externally mounted window spring balance replacement device assembly of claim 1 wherein said window track is attached to said window frame member with screws.

* * * * *